US006135396A

United States Patent [19]

Whitfield et al.

[11] Patent Number: 6,135,396

[45] Date of Patent: Oct. 24, 2000

[54] SYSTEM AND METHOD FOR AUTOMATIC TRAIN OPERATION

[75] Inventors: Russell U. Whitfield; William L. Matheson, both of Palm Bay; Fred A. Ford, Melbourne, all of Fla.; Wayne Basta, Saginaw, Tex.; Ernest L. Peek, Cocoa, Fla.; Anthony J. Guarino, Winter Springs, Fla.; Barbara S. Furtney; Charles F. Gipson, both of Palm Bay, Fla.

[73] Assignee: GE-Harris Railway Electronics, LLC, Melbourne, Fla.

[21] Appl. No.: 09/019,165

[22] Filed: Feb. 6, 1998

Related U.S. Application Data

[60] Provisional application No. 60/038,693, Feb. 7, 1997.

[51] Int. Cl.[7] ..... B61L 1/00

[52] U.S. Cl. ..... 246/182 R; 246/3; 246/4; 246/167 R

[58] Field of Search ..... 246/3, 4, 5, 122 R, 246/167 R, 182 R, 182 B, 182 C, 186, 187 R, 187 A, 218, 219, 220

[56] References Cited

U.S. PATENT DOCUMENTS

| | | | |
|---|---|---|---|
| 3,506,823 | 4/1970 | Failor . | |
| 3,650,216 | 3/1972 | Harwick et al. . | |
| 4,023,753 | 5/1977 | Dobler . | |
| 4,166,599 | 9/1979 | Auer, Jr. et al. . | |
| 4,617,627 | 10/1986 | Yasunobu et al. . | |
| 4,620,280 | 10/1986 | Conklin . | |
| 4,711,418 | 12/1987 | Aver et al. | 246/5 |
| 4,735,383 | 4/1988 | Corrie | 246/3 |
| 4,994,969 | 2/1991 | Petit . | |
| 5,072,900 | 12/1991 | Malon | 246/5 |
| 5,364,047 | 11/1994 | Petit et al. . | |
| 5,390,880 | 2/1995 | Fukawa et al. . | |
| 5,437,422 | 8/1995 | Newman | 246/5 |
| 5,474,267 | 12/1995 | Kubota et al. | 246/182 B |
| 5,487,516 | 1/1996 | Murata et al. | 246/182 C |
| 5,533,695 | 7/1996 | Heggestad et al. | 246/182 R |
| 5,676,059 | 10/1997 | Alt . | |

FOREIGN PATENT DOCUMENTS 539885 5/1993 European Pat. Off. .

*Primary Examiner*—Mark T. Le
*Attorney, Agent, or Firm*—Rogers & Killeen; Scott R. Hayden, Esq.

[57] ABSTRACT

A system and method for dynamically controlling the operation of a plurality of unmanned freight trains operating over a predetermined track layout. The method includes generating a movement plan that provides for the operation of the freight trains over several alternative routes within the track layout. A wireless communication system is used to transmit speed and braking commands to the freight trains. Commands for the wayside resources are transmitted, using wireless communications, as necessary to carry out the movement plan.

14 Claims, 6 Drawing Sheets

OBC 510

CENTRAL CONTROL STATION 200

OBC 510

CENTRAL CONTROL COMMUNICATION SYSTEM

SYSTEM AND METHOD FOR AUTOMATIC TRAIN OPERATION

This application claims the benefit of U.S. Provisional Application No. 60/038,693, filed Feb. 7, 1997.

BACKGROUND OF THE INVENTION

The present application is related generally to systems and methods for controlling railway systems and, in particular, to a system and method for scheduling and controlling a periodic train service using unmanned locomotives.

It has long been desired to reduce the cost of operating railway systems by reducing or eliminating the number of persons needed to control a train while maintaining a very high degree of safety. A small measure of success has been obtained in automatic control of trains (i.e., operation of trains without active human control) on small, fixed route railway lines, usually carrying passengers. For example, the Bay Area Regional Transit ("BART") system in San Francisco and the inter-terminal passenger shuttle systems at various airports such as Orlando and Tampa Bay utilize automatic train control systems to operate passenger railway systems over a relatively small geographic territory and utilize service which is generally periodic, i.e., a train shuttles between one terminal and another (or between one station and another) on a fixed and generally unvarying schedule, with fixed guideways.

Generally, in such prior art systems, the schedule of operation of the trains is fixed, often months in advance and may therefor be set in such a way to avoid or reduce the effect of conflicts in the use of track resources. For example, fixed, periodic trains can be scheduled to avoid two trains vying for the use of the same track at the same time.

Another general characteristic of many prior art automatic train control systems is the limited number of differences in the compositions of the trains. Usually, for example, every train on a particular segment of track (or on a "line") has a similar, if not an identical, composition, e.g., each train is composed of six passenger cars during non-rush hour and of ten passenger cars during rush hour operation. Because of the limited number of differences among the compositions of such trains, control systems which utilize fixed block methods of control are reasonably efficient. In fixed block control, the track layout is divided into track segments having lengths related to the stopping distances of the trains which operate over them. Trains are then controlled to avoid each other by separating them by a determined number of blocks. For example, in one such prior art system, a following train is permitted to run as long as it is no closer than three "blocks" from the train in front of it. If the distance between the trains is reduced to three blocks, the following train may be forced to slow its speed; if the distance is reduced to two blocks, the following train performs a full service braking; and if the distance is reduced to a single block, the following train performs an emergency stop. While such a control scheme may be reasonable when all trains have a like stopping distance, such a control scheme may be very inefficient if the trains being controlled vary considerably in stopping distance. For example, a relatively short, unloaded train may be able to stop in a much shorter distance than a relatively long, loaded train. In a typical fixed block system as used in many prior art automatic train control systems, the length of the block is usually set to a length relative to the stopping distance of the longest, heaviest train expected to be run on the track layout. Shorter, lighter or better braking trains running on such a fixed block system are controlled by such a system to follow at a distance much greater than required to stop safely. Such additional and unneeded distance between following trains wastes the track layout, permitting fewer trains to use a given track layout in a given amount of time. For a further explanation of the difficulties of fixed block systems, refer to the Matheson et al. U.S. Pat. No. 5,623,413, issued Apr. 22, 1997, entitled "Scheduling System and Method", and having some inventors in common with the present application.

In all railway systems, safety of operation is of paramount concern. Prior art systems and the present invention share a characteristic that they are designed to be "vital", i.e., portions of the control system, the failure of which could cause an unauthorized (and potentially dangerous) movement of a train, are made redundant and/or fail safe. Accordingly, most prior art automatic train control systems utilize train-centric or wayside-centric control schemes which permit movement of trains, manned or unmanned, only with respect to relatively local conditions which can be monitored and/or controlled by equipment carried by the train and/or by wayside units. For example, in the fixed block control system described above, the vital control apparatus may consist primarily of redundant wayside detection and authorization apparatus along the entirety of the track layout. This apparatus may by configured to control nearby fixed blocks of track by detecting the presence of trains thereon, the direction of switches, and the status of other trackside equipment (tunnel doors, hot box detectors, etc.) within the nearby control area. Logic circuits (often in trackside bungalows) are designed to implement the block movement rules discussed above and to signal train operators (or automatic equipment onboard a locomotive) to cause the train to proceed only when the track ahead is safe. The use of wayside-centric fixed block control has been successful in relatively small size track layouts with relatively similar trains operating thereon. However, when a relatively large track layout is involved, the cost of the vital (usually redundant) wayside equipment throughout the track layout can be considerable. In addition, purely local control of train operation such as carried out by typical wayside-centric equipment makes it extremely difficulty to optimize the throughput of trains across the entire track layout. Decisions as to train movement which are made with only a local perspective may cause significant ripple effects on other trains operating in the track layout. For example, if a particular train is placed on a siding to avoid an on-coming train on a single track system, the stopped train may fall behind its schedule causing other, subsequent meets which had been planned to be missed and throwing an entire schedule out of kilter whereas the schedule might have been saved if the train which the local wayside-centric control permitted to pass without stopping had been sent to the siding instead.

Prior art unmanned train control systems typically used locomotive-centric or wayside-centric logic circuits to determine vital control operation. In either situation, the local nature of the control decisions could have a ripple effect on other trains in the track layout as described immediately above.

The typical automatic train control system controls the operation of the unmanned train by communication sent through wayside units to the train. Often, these train control systems assign the train a block of track in which the train is authorized to run and assign a fixed speed for any given block. Moreover, typical automatic train control systems are routed and controlled using a fixed set of priorities and routes resulting in only a minimal amount of flexibility to work around problems. These systems do not have the predictive intelligence to plan beyond the next few blocks as monitored by the signal system. Other movement planners establish a long-term plan and rely upon human intervention when deviations to the plan become necessary.

The present invention incorporates centralized control of both the vehicles and the track resources. It accomplishes this centralized control by utilizing a flexible reactive movement planner which will continuously adjust train routes and controls so that system throughput is optimized. One advantage of this look ahead planner is that intelligent decisions can be made due to the collection of real time data as well as the use of predictive algorithms which are able to estimate upcoming requirements.

Many prior art automatic train control systems use a predetermined speed which may be set for each block, according to local conditions. While such a control scheme may permit the train to pass through a particular block at the highest speed, the train may arrive at the next or subsequent blocks ahead of the time when the block is available (prior to when a track resource within a block is available). Most prior art automatic train control systems handle this situation by merely commanding the train to stop and wait until the block or track resource becomes available. Such stopping and restarting of trains is generally detrimental, as wheel wear, wheel sliding, and track wear are generally increased substantially during train stopping or starting. Likewise, train components such as the transmission and similar tractive components wear substantially more when stopping or starting. In contrast to many systems in the prior art, the present invention determines and commands the trains operating within its purview to follow a specified speed trajectory along its route which can be optimized to increase the throughput of trains through the track layout and to adjust the speed of the trains to obtain needed pacing between trains or between a train and a track resource without the need for unnecessary braking.

One of the benefits of the present system is the improved throughput over the rail that results from planning efficient train movements. Unlike the typical movement planner which establish a long term plan but can not dynamically adjust the plan, the present invention can rapidly react to changes in predicted needs and create a new movement plan within one second. The reactive movement planner constantly receives train position and velocity along with switch status and can update the movement plan in order to reflect actual performance on the rails of each vehicle. Replanning of the train movement may be accomplished frequently in order to stay current with the activities on the railway system.

In the present invention, all data received from the vehicles and the wayside interface units may be stored in a database located at the centralized control station. When a replan is required, the reactive movement plan can access the most current data as reflected in the database in order to plan the optimal movement of the vehicles and establish train routes and estimated time of arrival at selected control points. Since the planner is adjusting the train routes at regular, very short intervals (approximately once per second) it can adapt quickly to changing conditions. In many cases, the new plan will be identical to the former plan except that it has been extended for an additional second because no unexpected changes will have occurred. The central control station converts the movement plan developed by the reactive movement planner into commands for locomotives and for the controlling of the wayside resources. The central control station may also continuously poll the locomotives for status and location and the wayside interface units for the status of track resources so that it has the most current status.

The present invention incorporates the ability to selectively lockout or remove sections of the railway and associated wayside resources from being available to the movement planner. Manual lockouts are a critical function to the present invention because they are the primary method of protecting work crews and maintenance equipment which may occupy the track. Manual lockouts may be initiated locally at a wayside interface unit or from the central control station. To lock out a section of track for repair or any other use, the section must be clear of existing traffic. Once locked out, the section is no longer available to the movement planner to implement the movement plan and no new traffic will be allowed to enter.

As an additional safety feature, each wayside interface unit may contain up to two emergency shutdown switches. Activation of one of these switches will cause all trains within a programmed portion of the railway system or all trains within the entire railway system to stop until the condition is cleared. The area controlled by each switch is not limited to areas surrounding the wayside interface unit and will be programmed during initial system configuration. When an emergency switch is activated, the central control station will log the time and location of this event. These switches are meant to be used in emergency situations only since some or all of the railway system operation will be shut down until the problem is cleared. Once the emergency condition is cleared the system will restart and continue normal operations, adjusting for any changes required due to the system shutdown.

Accordingly, it is an object of the present invention to provide a novel method of automatic train control utilizing centralized control of the trains and the wayside resources.

It is another object of the present invention to provide a novel method to reduce brake maintenance and prevent rail abuse.

It is yet another object of the present invention to provide a novel method of improving throughput over a railway system by planning efficient train movements.

It is still another object of the present invention to provide a novel system and method for providing vital control of train movement while reducing required redundant wayside units throughout a track layout.

It is still another object of the present invention to provide a novel method of increasing safety through centralized vital control of train movement.

it is yet another object of the present invention to provide a novel method to detect and react to constraints including broken rail, weather, speed restrictions, etc. and still optimize train movement.

It is still another object of the present invention to provide a novel method to spot a train precisely repeatedly for unloading operations.

These and many other objects and advantages of the present invention will be readily apparent to one skilled in the art to which the invention pertains from a perusal of the claims, the appended drawings, and the following detailed description of the preferred embodiments.

DESCRIPTION OF PREFERRED EMBODIMENTS

Figure 1:
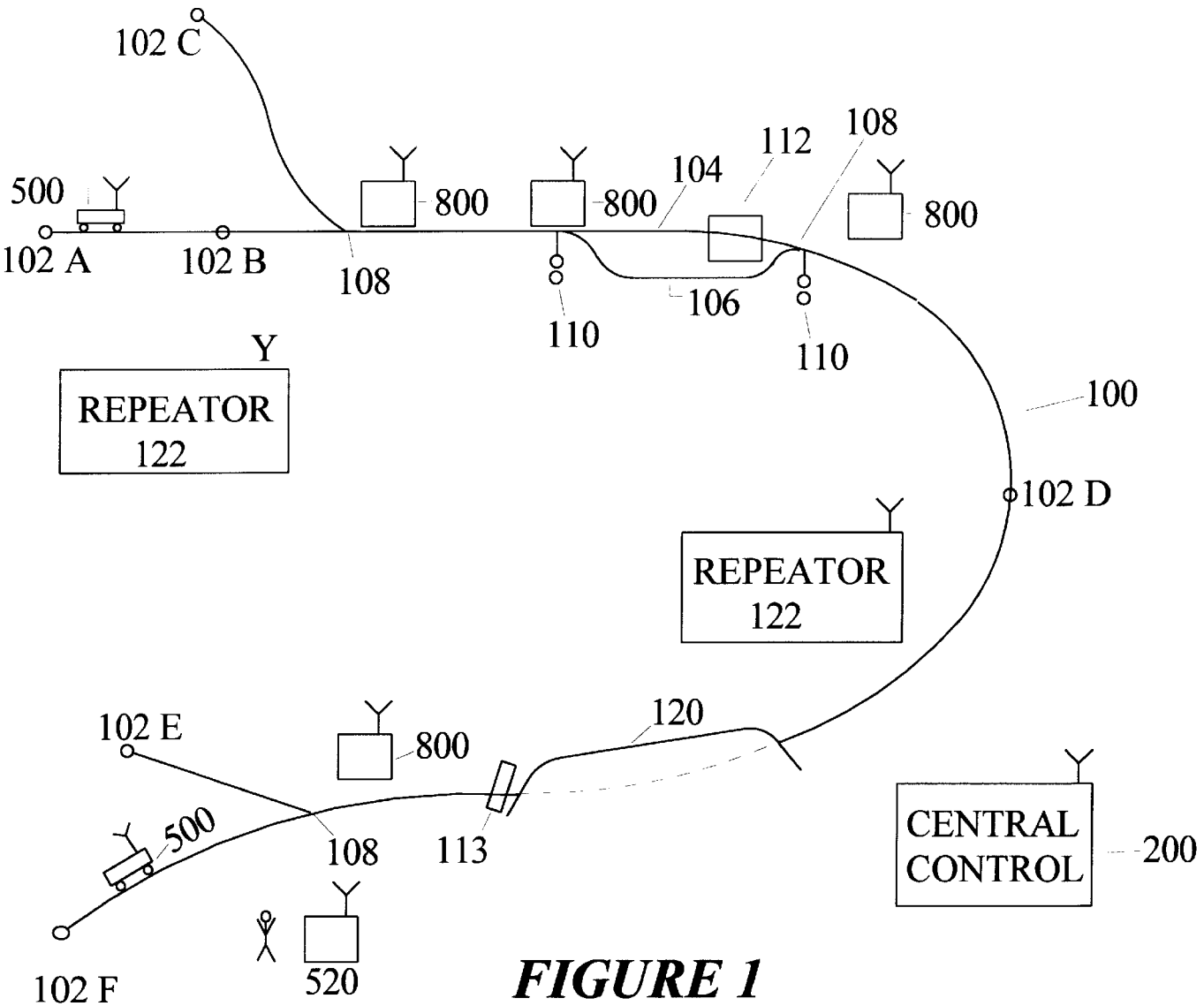
FIG. 1 is a simplified pictorial overview of the major components of the Automatic Train Operation (ATO) system and method of the present invention.

With reference to FIG. 1, the present invention may be used in a railway system having one or more sets of tracks 100 laid out in conventional fashion. The tracks 100 may be single, double or any arbitrary number of parallel tracks and the number of parallel tracks will usually vary within a particular control area. As depicted in the track layout of FIG. 1, the tracks may interconnect plural destinations 102 which may be at the terminals of portions of the track 100 or in a mid portion of the track layout. Generally, plural routes may interconnect many of the destinations. For example, between a first destination at 102A and a second destination at 102D, a train may take either of two routes using either track segment 104 or track segment 106. Track segment 106 may be considered a siding by one skilled in the art. At various locations along the track 100 may be found a variety of wayside resources, also well known in the prior art, such as switches 108, signals 110, hot box detectors 112, and tunnel door monitoring and control system 113. The wayside resources control the configuration of the tracks, signal the status of the track system to train personnel, and measure or identify certain conditions. Those skilled in the art will appreciate that the foregoing exemplary list identifies but a few of the many different types of wayside resources conventionally used to control the track and trains running thereon and the present invention is not limited to systems having only the expressly-mentioned resources.

With continued reference to FIG. 1, many of the wayside resources have associated with them a wayside interface unit ("WIU") 800 which is in wireless communication with a central control station 200. The central control station 200 is also in wireless communication with one or more locomotives 500. In a tunnel 120, in a high-walled area (such as a city or mountain canyon), or because of the distance from the central station control 200, signal repeaters 122 may be utilized to provide communications between the trains 500 or the WIUs 800 and the central control station 200.

In operation, the central control station 200 sends control signals to both the locomotives 500 and to certain of the WIUs 800 and receives status information from the locomotives 500 and from some of the WIUs 800. As explained further below, using the information provided from the locomotives 500, the WIUs 800, and the operator of the train system, the central controller 200 creates movement plans to optimize the safe movement of locomotive 500 through the track layout and then controls the operation and speed of the locomotives 500 and the operation of the various wayside resources (through the WIUs 800) to effect the movement plan. As the central control station 200 receives updated status information from the locomotives 500 and the WIUs 800, the control of the train system to implement the movement plan is dynamically updated and executed.

Note that plural of the wayside resources may be controlled by and/or communicate through a single WIU 800. For example, the hot box detector 112, switch 108 and signal 100 in the proximity of the WIU 800A may all be controlled by and/or communicate through WIU 800A. In conventional fashion, the wayside resources may communicate with a WIU using wireless, to the WIU 800. Depending on the needs of the specific wayside resource, the communication between the WIU 800 and the wayside resource may be unidirectional or bidirectional. In turn, the WIU 800 communicates (usually bidirectionally) with the central control station 200 to provide it with status information concerning the wayside resources associated with the particular WIU 800 and to obtain commands from the central control station 200 concerning the operation of the associated wayside resources.

Figure 2:
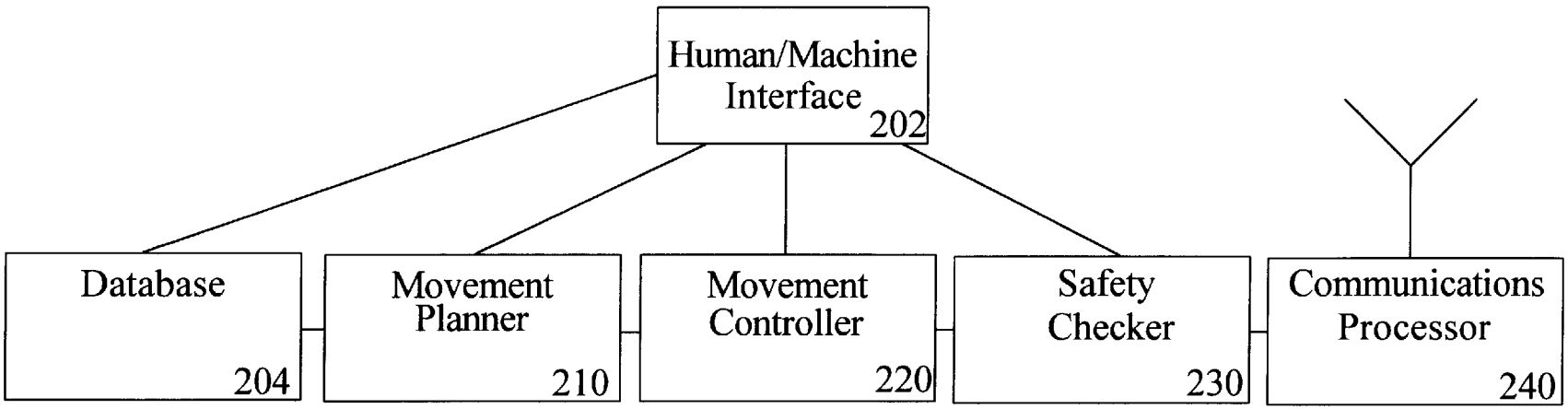
FIG. 2 is a simplified block diagram of a central control station which can be used in the system of FIG. 1.

With reference now to FIG. 2, a central control station 200 of the present invention includes a human/machine interface (HMI) 202 to receive instructions from the train system operator regarding the trains which must be moved through the track layout controlled by the central control station 200. The central control station has access to a database 204 of the track layout, the location of the wayside resources, the rules (both natural and imposed) regarding the use of the track and the wayside resources, and the topography of the track along the entire track layout. The information in the database 204 is provided to a movement planner 210 which, based on the user's requests for train service, determines a movement plan which will obtain the desired train movement safely and efficiently. The movement plan generally specifies the timed use of the train system resources by the trains being scheduled during the applicable scheduling period.

Once a movement plan has been determined, it is provided to a movement controller 220 which determines the specific train commands and wayside resource commands which are needed to implement the movement plan. The movement plan allocates the timed use of each of the track segments and wayside resources to the various trains input by the system operator. The movement plan is provided to a movement controller 220 which determines the specific commands which must be sent to the trains and to the wayside resources (generally through the WIUs) to implement the movement plan. The determined commands are passed through a safety checker 230 which independently determines that the implementation of the commands by the commanded train or wayside resource will not cause a safety violation. If the command is determined to be safe, the safety checker 230 will pass the command to a communications processor 240 which will send the command to the train/WIU, through a wireless transmission.

The movement planner 210 may be any conventional planning system which will allocate the fixed resources of the track and wayside resources to the use of the trains specified by the user. In a preferred embodiment, the movement planner may use the system described in the aforementioned "System Scheduler and Method" patent to Matheson et al. This planner utilizes both rule based and constraint based processing to determine the optimum allocation of track and wayside resources, and then implements this plan through procedural technology of the movement controller 220 to control movement of the trains in a fine grained manner to ensure adherence to performance schedules.

In one embodiment of the present invention, the movement planner 210 continually receives train location and velocity from the locomotive 500 and track and wayside resource status from the WIUs 800. As needed, the movement planner 210 can update the movement plan in order to accommodate actual performance of the trains over the track layout.

With proper design, the movement planner may be used to decrease wear and tear on various of the railway equipment. For example, it is known that starting and stopping of the train from and to a complete stop causes wear of brake equipment, such as brake pads and braking pneumatic or electrical actuating equipment. Similarly, when a train is started from a dead stop, increased wear is often experienced by the wheels and track as the wheels will often slip until a loaded train is brought up to some speed. The speed control of the present invention can be used advantageously to reduce the wear and tear on braking equipment, wheels, and track by avoiding the generation of movement plans which call for the train to be stopped at the end of its currently planned (or future) track segment. For example, as described in the Background section of the present application, it is well known to schedule the movement of trains by fixed blocks. Often in prior art systems, the train is provided with an indication of the blocks of track over which it is authorized to run (often called an "enforceable authority" or a "movement authority") and the train is required to stop at the end of those blocks if another signal has not been received extending the enforceable authority to the next series of track blocks. The signal may be received from wayside equipment or from a central source. In such prior art systems, the trains are often permitted (or required) to run at the maximum speed permitted for the particular track segments within its enforceable authority. In such prior art systems, this operational technique may result in a train arriving at the end of its enforceable authority before the adjacent track segments are clear and the arriving train will be required to stop and wait for clearance of the track ahead. In many systems, such operations are the norm. A similar situation may arise if the train is scheduled to use some wayside resource such as a loading platform. If the train arrives before the loading platform is clear, the arriving train will be required to fully stop and then restart.

In one aspect of the system of the present invention, the movement planner can schedule the trains and the movement controller can command the trains to operate at other than preset speeds over the track segments. Thus, if the movement planner realizes that the track segments or needed equipment ahead of a train will be occupied, the movement planner may slow the arriving train for a period of time prior to its arrival at the end of the block or at the needed equipment so that the arriving train will enter the next track segment at a safe distance behind the train leaving the segment or equipment. In this way, the arriving train will not be required to come to a stop and will not need to restart from a dead stop, conserving brakes, wheels, and track surface. Of course, if a intentionally slowed train interferes with the movement of other equipment, a decision will have to be made as to whether to stop the train or to accept the interference caused by slowing the train. This is a decision which a properly configured movement planner may make, given an estimate of the costs and priorities associated with each action.

In another advantage of one embodiment of the present invention, brake wear can also be reduced by using various forms of dynamic braking available to many trains. For example, in electro-diesel locomotives, the train can be slowed considerably by idling the diesel engine and using the resistance of the electrical motor (being turned by the wheels) to slow the train (called traction braking). Similarly, the train can be slowed by idling an electrical engine, the slowing being caused primarily by friction within the power train (static and dynamic friction) and air friction opposing the movement of the train. In a situation similar to that discussed above, the movement planner may be utilized to take opportunities to control the movement of the trains through the track layout through the use of variable speed and dynamic braking instead of the use of friction brakes.

If the costs utilized within the movement planner are favorable, the movement planner can opt to slow trains within certain segments rather than to have the trains operate at full speed only to have to join a queue awaiting other trains or equipment at the end of a segment. Because the central movement planner has knowledge of when the track ahead or equipment ahead is expected to be available to a given train, the planner may elect to slow the train sufficiently to permit the track or equipment to clear before the arrival of the train.

Similarly, even when a train must be stopped for whatever reason, the movement planner may use a combination of braking types to effect the stop and thereby reduce wear on the friction braking devices. For example, a train can first be braked by dynamic braking (with or without the engine, i.e., traction braking) and then by use of the conventional friction brakes. Note that in this situation, the friction brakes are not used until dynamic braking has removed energy from the train. Thus, there will be reduced wear on the brake pads or similar friction equipment and a reduced stress on the actuators associated with the brakes.

In a preferred embodiment, the movement planner 210 will output a plan every second to the movement controller 220. The movement controller 220 will then generate specific commands to the locomotives 500 and the WIUs 800 as required to execute the plan. Specific commands to the locomotive 500 include Enforcement Authority and speed. Specific commands to the WIU 800 include switch positioning controls and tunnel door opening and closing.

The movement controller 220 may also use the information obtained from the polls of the locomotives 500 for status and location, and the WIUs 800 for status of track circuits and switches and tunnel doors so that the movement controller 220 has the current railway status and can ensure the proper execution of the movement plan.

In addition to the status of the locomotive and the wayside resources, the movement planner 210 receives inputs from the HMI 202. The HMI 202 allows the system operator to input control requests for trains and trackside equipment, change the number or designation of active trains, modify the train consists and modify production goals. The HMI 202 includes a CRT display and keyboard. The CRT will display a number of screens appropriate to viewing railway status, train status, control commands, alarms and alerts. The central control station 202 also receives commands sent by the hand held locomotive remote control 520 to provide safety checking of the commands with the movement of the train.

The database 204 maintains the status of the wayside resources, the train locations, the track profile and provides this information to the movement planner 210 to allow the determination of such parameters as safe breaking distance necessary to the development of the movement plan.

In response to an unexpected status change, either due to an operator request through the HMI 202 or in response to an unexpected change in train or wayside status, the movement planner 210 conducts a rapid replan. The movement planner 210 will access the database 204 to establish the current status of traffic on the railway. From the database 204, the movement planner 210 derives all of the conditions it needs to optimize movement over the railway system. The movement planner 210 performs the replanning function and returns recommend enforcement authorities and speeds to each train. The new plans are then converted by the movement controller 220 into commands for the locomotive 500 and the WIU 800.

In a preferred embodiment, the movement planner 210 maximizes performance by minimizing a user defined cost function. This means that train movements will be prioritized in order to assure the most cost-effective use of rail resources. For example, a loaded train (which normally has priority) may be directed to a siding to allow an unloaded train to pass if the wayside resources are currently available to the unloaded train but not the loaded train.

In determining the distances between trains, the movement planner is not tied to fixed blocks and may use moving block control logic to increase the throughput of the system by requiring a separation between trains which is a function of the actual braking ability of the trains, not merely of the geographic layout of blocks of track.

In a preferred embodiment, neither the movement planner 210 nor the movement controller 220 is a vital subsystem. To guarantee that no unsafe train movements are commanded, a separate safety checker 230 will check all commands coming out of the movement controller 220 to prevent any safety violations. Generally, the safety checker 230 will not check to see if the command from the movement controller 220 is a smart one, instead it will only verify that a very specific set of rules have not been violated. For example, a command from the movement controller 230 which would send a train over a switch which has not been confirmed in the correct position or a command which would send a train into a locked out block would be prevented from being transmitted to the train by the safety checker 230. In a vital system, the safety checker 230 would generally be considered vital hardware and may be backed up by a parallel processor.

Figure 3:
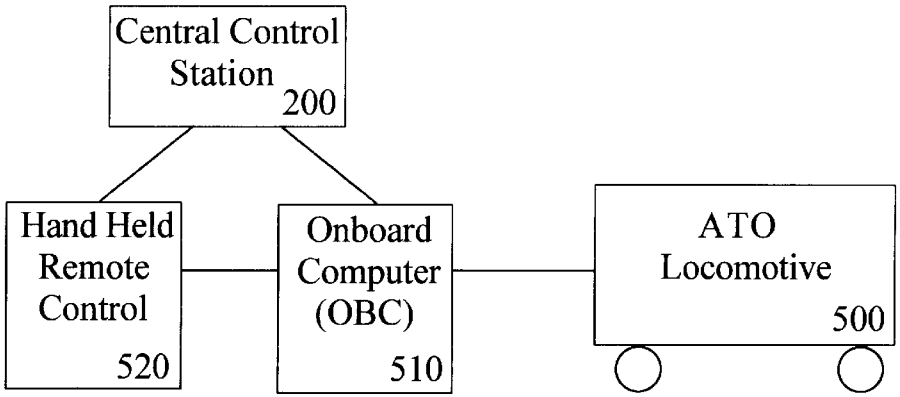
FIG. 3 is a simplified block diagram of a locomotive control system which can be used in the system of FIG. 1.

With reference now to FIG. 3, a locomotive control system in accordance with the present invention provides the controls to drive the locomotive 500 and provides position feedback to the central control station 200 via wireless communication. The heart of the locomotive control is the locomotive onboard computer (OBC) 510. The OBC 510 receives speed control and enforcing authority limits from the central control station 200. The OBC 510 provides commands to the locomotive to control the speed and direction of the locomotive 500.

Hand held locomotive remote control 520 can be used to move a single locomotive at creep speed either forward or backward within a limited area, such as at a loading or unloading platform. This remote control 520 performs wireless communications with the central control station 200 for confirmation of commands then communicates to the OBC 510 which supplies the command to control the locomotive 500. To ensure proper locomotive movement, the central control system 200 generally will release the locomotive 500 into local remote operation. This is accomplished by an operator request through the HMI 202 commanding that a particular locomotive be released for local control. The central control system 200 will then lockout the area of the track requested and send the requested locomotive a limit of authority for that area only and command the locomotive 500 to remote control mode so that it can accept commands from the remote control 520. The central control system 200 continuously monitors the locomotive 500 in remote control mode and the commands sent to the locomotive 500 from the hand held locomotive remote control and will stop the locomotive 500 if an unsafe condition is detected.

Figure 4:
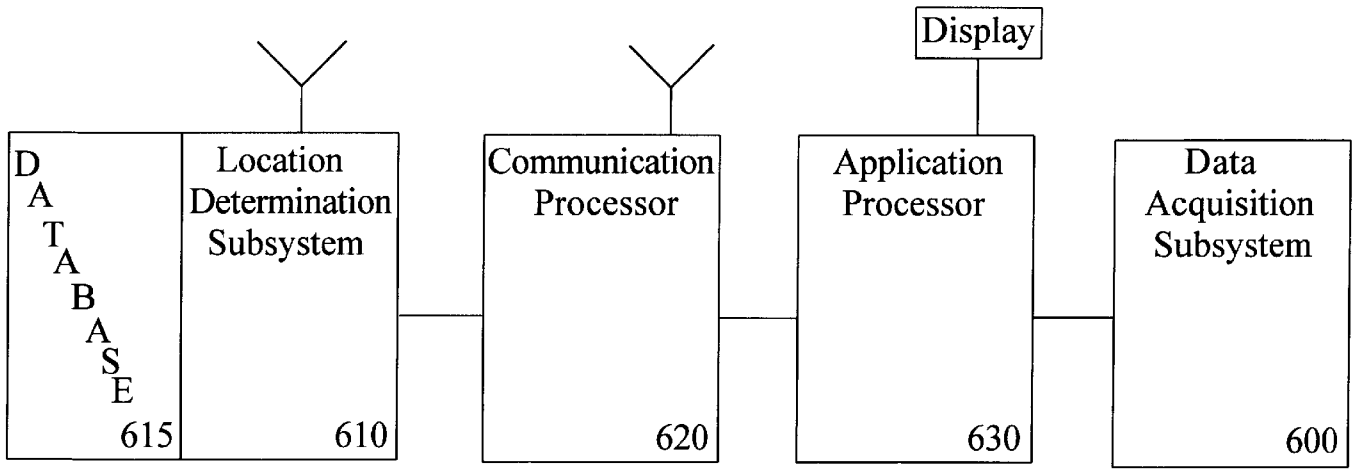
FIG. 4 is a simplified block diagram of a locomotive Onboard Computer (OBC) which may be used in the locomotive control system of FIG. 3.

With reference to FIG. 4, the OBC 510 may include a data acquisition subsystem (DAS) 600 which monitors the functional actions of the locomotive 500 including various parameters, such as, brakes, wheel tachometer and speed commands. The data collected by the DAS 600 is provided to an application processor 630 which may determine location, safe stopping distance, compliance with speed restrictions, etc., some of which may be based on the location of the locomotive 500 within the track layout.

The OBC 510 may also include a Location Determination Subsystem (LDS) 610 which uses various sensors along with a track profile database 615 to determine the location of the train as it travels the railway system. In a preferred embodiment, the present invention utilizes track tags, train tachometers and train heading as inputs to the LDS 610 to provide an accurate position. The LDS 610 can track the train's location by dead-reckoning using the train's axle generator to determine distance travelled. The optical sensors, placed at known positions within the tunnel can be used to reset any error buildup from the axle generator and to calibrate the axle generator. In another embodiment, the present invention may utilize Differential Global Positioning System (DGPS), train speed, train heading and train acceleration as inputs to a Kalman filter to provide an accurate position. An example of such a system which may be used in the present invention is disclosed in the Zahm et al. U.S. Pat. No. 5,867,122. In tunnels, where DGPS may not be available, track based optical sensors can be used to assist in the precise location of the locomotive 500. It should be understood that any conventional location determining system may be used, including those system using optical sensors, track circuits, etc.

With continued reference to FIG. 4, a communication processor 620 receives communications from the central control station 200 and the WIU 800. The communication processor 620 transmits the train's location and trains speed as well as any anomalies from the OBC 510 to the central control station 200.

With continued reference to FIG. 4, an application processor 630 monitors the location of the locomotive 500 with respect to the enforceable authority limits and continually determines the safe braking distance for the locomotive 500 to confirm that the locomotive 500 can stop safely within the limits. If a locomotive 500 approaches the point at which the safe breaking distance is at the enforceable authority limit, the application processor 630 generates a control signal to initiate full braking to stop the locomotive 500 prior to the end of the enforceable authority limit.

The application processor 630 monitors the speed of the locomotive from the DAS 600 and compares it to the track speed limit and any operator applied speed restrictions for its current location from the LDS 610. In the event that the locomotive 500 exceeds its speed limit, the application processor 630 sends a control signal to the locomotive to slow the locomotive 500. If the OBC 510 is unable to determine the trains velocity or the location of the train, a control signal is sent to the locomotive 500 to stop the train.

Figure 5:
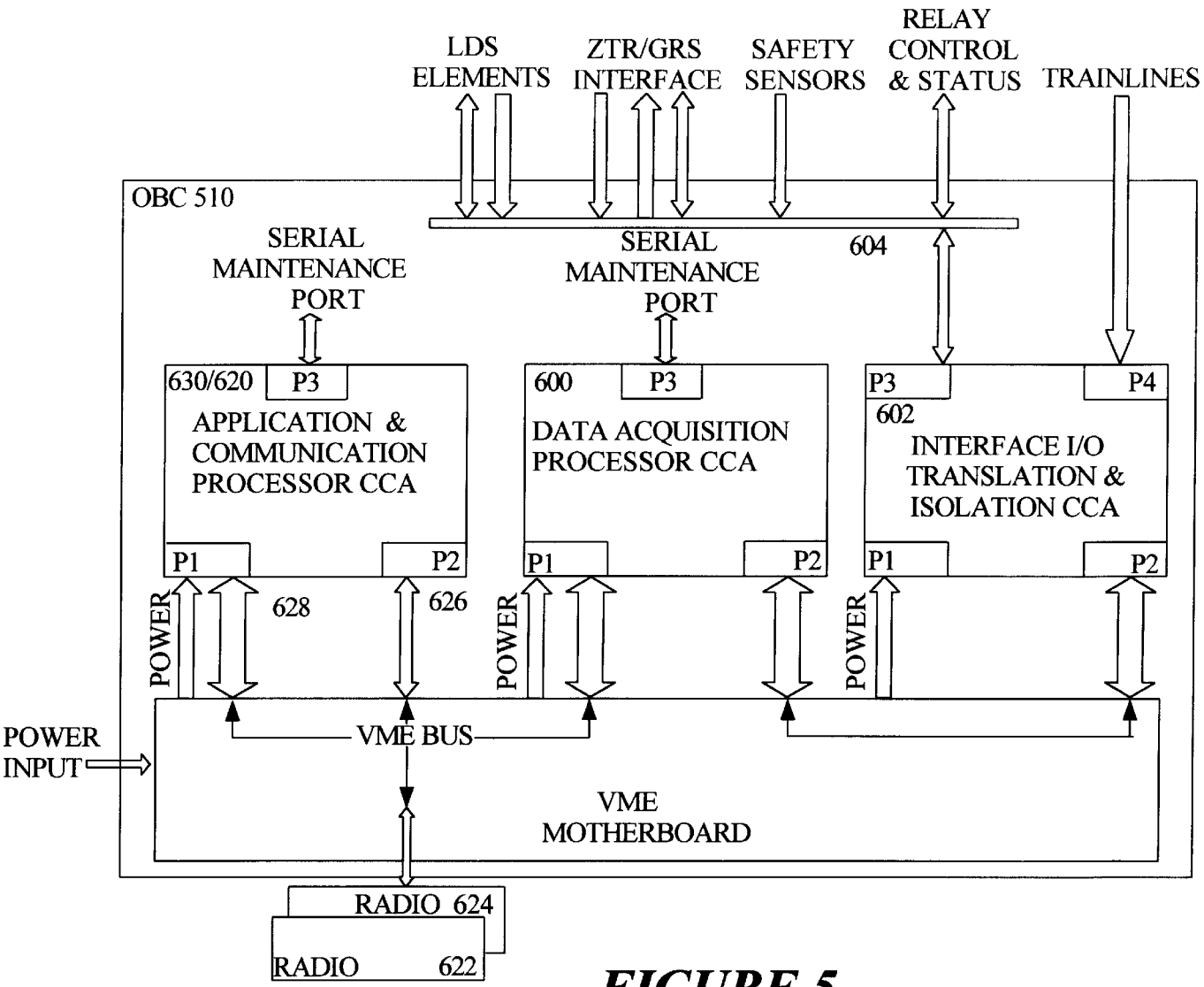
FIG. 5 is a simplified block diagram of an implementation of the onboard computer system of FIG. 4.

A specific implementation of an OBC 510 in accordance with the present invention is illustrated in FIG. 5 in which similar elements to those in the system of FIG. 4 bear the same reference numeral. The communications processor 620 and the application processor 630 may be implemented in a Motorola 68XXX single board processor currently available from Matrix. The communications processor 620 and the application processor 630 may utilize dual redundant radios 622, 624 for high speed communications with the central control station 220. Between the radios 622, 624 and the processor 620, high speed communications ports 626, 628 provide framing protocol and service interface which may be compliant with a known standard such as the ANSI/IEEE 802.11 wireless local area network (LAN) standard. The signalling protocol is a Carrier Sense Multiple Access/Collision Detection (CSMA/CD) protocol in accordance with the ANSI/IEEE 802.11 standard.

With continued reference to the example OBC system of FIG. 5, the data acquisition function 600 provides an interface 602 to the discrete I/O train sensors used in the system of the present invention. The data acquisition function 600 also provides an analog interface 604 to read the analog control signals in the locomotive 500 such as the air brake pressure transducer.

As noted above, the specific implementation of the OBC shown in FIG. 5 is illustrative only and not intended to be limiting. Those skilled in the art will understand that other specific embodiments of the OBC may be implemented within the teachings of the present application and the scope of the present invention.

Figure 6:
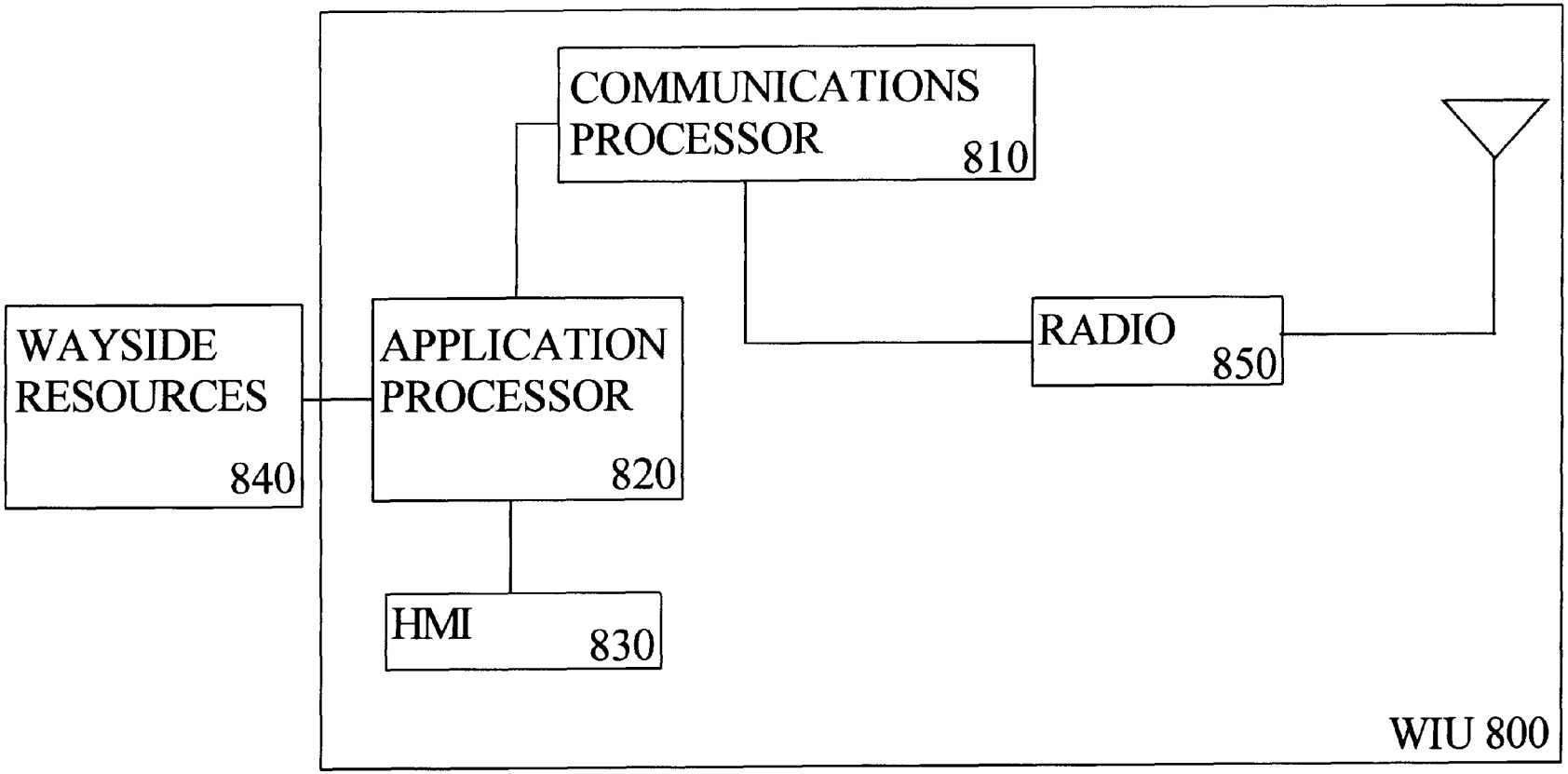
FIG. 6 is a simplified block diagram of a Wayside Interface Unit (WIU) which may be used in the system of FIG. 1.

With reference now to FIG. 6, the WIU 800 acts as the controller, data gatherer and communication interface for all wayside functions including broken rail detection, switch control and monitoring, switch heater operation, manual lockouts, etc. In a preferred embodiment of the present invention, a communications processor 810 receives control signals from the central control station 200 through radio 850 once per second. Radio 850 may be comprised of more than radio where each radio is assigned specific tasks in accordance with a desired communication plan. An application processor 820 receives the control signals from the communication processor 810 and generates commands for the wayside resources 840 in accordance with the requested actions from the central control station 200. Application processor 820 continually monitors the status of the wayside resources 840 and reports the current status of the WIU 800 to the central control station via communications processor 810 and radio 850.

With continued reference to FIG. 6, HMI 830 allows an operator to enter inputs and receive system status updates from WIU 800. For example, upon request from an operator, the central control station 200 may allow locomotive 500 to accept movement commands from the HMI 830.

Figure 7:
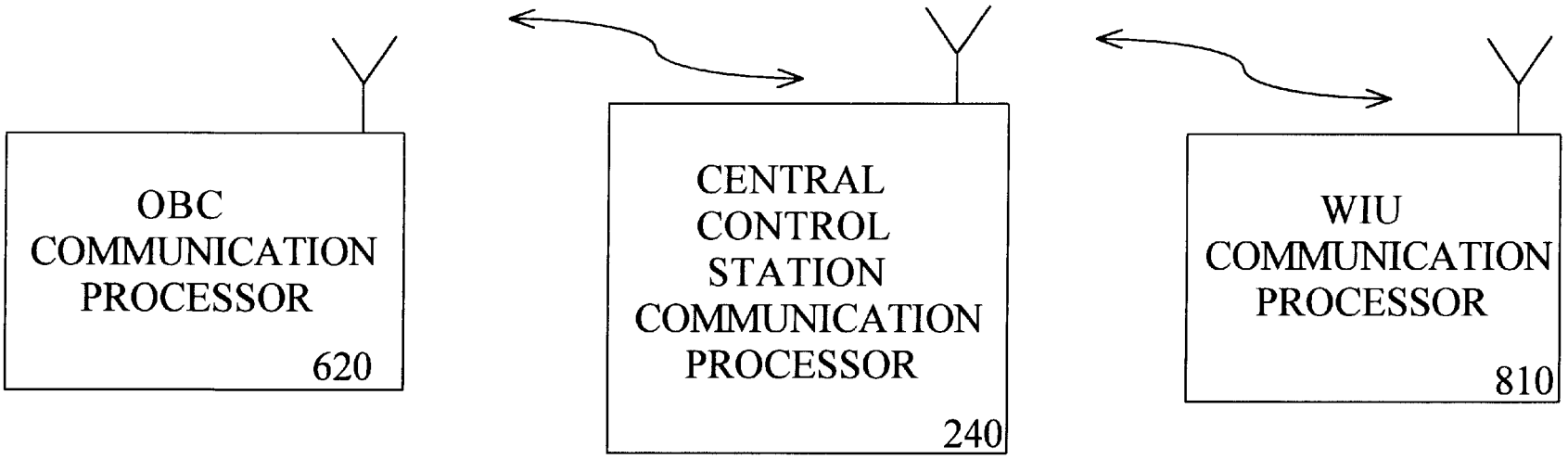
FIG. 7 is a simplified block diagram of a central control communication system which may be used in the system of FIG. 1.

With reference now to FIG. 7, the central communication system enables the central control station 200 through the central control station communication processor 240 to exchange data with equipment on the locomotive 500 through the OBC communication processor 620 and with the wayside resources 840 through the WIU communication processor 810. In response to receiving a location report from locomotive 500, the central control station 200 will issue an enforceable authority command which informs the locomotive 500 where on the track 100 it is allowed to go along with specific commands on how to proceed along that route. This basic communication process is repeated for each locomotive and represents the dominant traffic through the central communication system. While the present invention uses RF communication to communicate between the locomotive 500, the WIU 800 and the central control station 200, it is contemplated that any number of conventional high speed wireless digital data communication systems may be used.

While preferred embodiments of the present invention have been described, it is to be understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. A system for controlling the operation of plural unmanned railway freight trains operating over a predetermined track layout, said trains being dynamically scheduled to operate over plural alternative routes between plural destinations within said track layout, and said track layout including plural switches which alter the path of trains running along said track layout, said system comprising:

means for generating a movement plan by scheduling plural freight trains to operate at desired times between plural destinations within said track layout, said movement plan providing for the safe operation of the trains by eliminating conflicts in the use of particular portions of said track layout by different trains;

means for dynamically commanding said freight trains to carry out the movement plan, said commanding means including the wireless transmission of speed commands for at least a portion of the transmission path from a central location to said trains;

means for determining the location of each of said trains along the track layout;

means for communicating said determined location to said means for dynamically commanding, said means including wireless transmission of said determined location;

means for commanding wayside resources to carry out the movement plan, said commanding means including the wireless transmission of wayside resource commands for at least a portion of the transmission path from the central location to said wayside resources;

means for determining the state of each of said wayside resources; and, means for communicating said determined state to said means for dynamically commanding, said means including wireless transmission of said determined state;

whereby the operation of said trains along said track layout is dynamically controlled by said means for dynamically commanding.

2. The system for controlling of claim 1 wherein said means for dynamically commanding includes means for determining the stopping distance of said trains based on train composition, location of said trains within said track layout, and train speed.

3. The system for controlling of claim 2 wherein said means for dynamically controlling dynamically determines the stopping distance of said trains and maintains a distance between adjacent trains on the same track based on said stopping distance.

4. The system for controlling of claim 1 wherein said means for dynamically commanding provides a movement authority to said trains based in part on said determined locations and on said determined states.

5. The system for controlling of claim 4 wherein said means for dynamically commanding provides said movement authority based in part on the stopping distance of each train taking into account train composition and train location.

6. The system for controlling of claim 1 wherein said means for commanding wayside resources controls the operation of plural track switches.

7. The system for controlling of claim 1 wherein said means for determining said determined state operates to determine the state of plural track switches.

8. A system for controlling the movement of plural freight trains providing a periodic service over a track layout using an unmanned locomotive, comprising:

a track layout interconnecting plural destinations, said track layout including one or more sets of tracks providing plural different routes between two or more of the plural destinations and said layout accommodating plural trains simultaneously;

plural wayside resources associated with the tracks at various points along the length thereof, said wayside resources comprising one or more of switches, hot box detectors, broken rail detectors, train occupancy detectors, tunnel door monitoring and control systems, and visual indicators;

plural wayside communication devices, each communicating in a two way communication with one or more of said wayside resources and each said wayside communication device communicating with a central control station at least in part through a wireless communication;

plural locomotive control devices, each device controlling the throttle and brakes of a locomotive;

plural train position detecting devices, each device carried onboard a train for detecting the position of the train on the track layout;

plural train communication devices, each device carried onboard a train and establishing communications between said locomotive control devices and said central control station at least in part through a wireless communication and each said device establishing communications between said train position detecting devices and said central control station;

a resource input device to receive signals indicating the service desired from trains operating over the track layout;

a movement planner which generates a specific movement plan which will operate trains over the track layout to meet the desired service, said movement planner including the track layout, rules regarding the operation of trains within the track layout, and the identification and location of the wayside resources;

a vital control module which receives signals indicating the current position of the trains and the current status of the wayside resources and which generates signals specifying the speeds at which each of the trains are to be run in accordance with the movement plan and which generates signals controlling the operation of the wayside resources; and, wherein the central station provides the speed specifying signals and the wayside resource controlling signals to the train communication devices and said wayside resource communication devices and which provides the current train position signals and the current status of wayside resource signals to said control module.

9. The system for controlling of claim 8 wherein plural of said trains have a stopping distance different from each other and wherein the movement planner maintains stopping distance between said plural trains based on said stopping distances.

10. The system for controlling of claim 8 wherein the movement planner attempts to slow trains instead of stopping them to avoid a conflicting use of a track segment.

11. The system for controlling of claim 8 wherein the movement planner causes a train to stop by using dynamic braking followed by frictional braking.

12. In a railway system comprising a track layout over which plural trains operate simultaneously on a nonperiodic basis, said track layout providing plural alternate routes between various points along said track layout, said track layout having associated plural wayside resources at various points, and said trains having means for automatic operation of their throttle and brakes, a method for controlling the movement of trains within the track layout comprising the steps of:

(A) generating a movement plan which schedules the trains to use the track and the wayside resources on a non-conflicting basis;

(B) receiving by wireless communication the location and speed of each train controlled by the system;

(C) receiving by wireless communication the operational status of each of the wayside resources controlled by the system;

(D) determining from said generated movement plan the movement of the trains which will carry out the movement plan;

(E) determining from said generated movement plan the operation of the wayside resources which will carry out the movement plan;

(F) transmitting by wireless communication from a central station to each of the trains the determined movement of the trains; and, (G) transmitting by wireless communication from said central station to the wayside resources the determined operation of the wayside resources.

13. The method of controlling of claim 12 further comprising the steps of:

(H) operating the trains in accordance with said transmitted movement;

(I) operating the wayside resources in accordance said transmitted operation; and, (J) repeating steps (A) through (I) continuously.

14. The method of controlling of claim 12 wherein said transmitted movement comprises a commanded speed and a movement authority.

* * * * *